US006218097B1

(12) United States Patent
Bell et al.

(10) Patent No.: US 6,218,097 B1
(45) Date of Patent: Apr. 17, 2001

(54) COLOR PHOTOGRAPHIC SILVER HALIDE MATERIAL

(75) Inventors: Peter Bell, Köln; Ralf Büscher, Lohmar; Lothar Rosenhahn, Köln; Heinz Wiesen, Euskirchen; Ralf Wirowski, Köln, all of (DE)

(73) Assignee: Agfa-Gevaert (DE)

( * ) Notice: Subject to any disclaimer, the term of this patent is extended or adjusted under 35 U.S.C. 154(b) by 0 days.

(21) Appl. No.: 09/385,734

(22) Filed: Aug. 30, 1999

(30) Foreign Application Priority Data

Sep. 3, 1998 (DE) ..... 198 40 109

(51) Int. Cl.[7] ..... G03C 1/08; G03C 7/26; G03C 7/32

(52) U.S. Cl. ..... 430/544; 430/505; 430/555; 430/506; 430/557; 430/957; 430/549

(58) Field of Search ..... 430/543, 544, 430/555, 505, 506, 557, 957, 549

(56) References Cited

U.S. PATENT DOCUMENTS

| | | | | |
|---|---|---|---|---|
| 4,480,028 | * | 10/1984 | Kato et al. | 430/544 |
| 5,641,613 | * | 6/1997 | Boff et al. | 430/544 |
| 5,677,118 | * | 10/1997 | Spara et al. | 430/555 |
| 5,998,123 | * | 12/1999 | Tanaka et al. | 430/555 |
| 6,015,657 | * | 1/2000 | Krishnamurthy et al. | 430/555 |

FOREIGN PATENT DOCUMENTS 195 25 666 10/1996 (DE) .

* cited by examiner

*Primary Examiner*—Geraldine Letscher
(74) *Attorney, Agent, or Firm*—Connolly Bove Lodge & Hutz LLP

(57) ABSTRACT

A colour photographic silver halide material having a support and at least one photosensitive silver halide emulsion layer which contains a magenta coupler of the formula (I)

(I)

in which $R_1$ to $R_3$, a, b, c and X have the meaning stated in the description, which material contains a DIR coupler of the formula (II)

(II)

in which $R_6$ to $R_{11}$ have the meaning stated in the description,
is distinguished by improved processing stability.

10 Claims, No Drawings

COLOR PHOTOGRAPHIC SILVER HALIDE MATERIAL

This invention relates to a colour photographic silver halide material which is distinguished by improved processing stability.

It is known that processing stability, especially in the event of pH fluctuations in the developer, is dependent upon the nature of the colour coupler used. In the case of magenta couplers, pyrazolone couplers are, for example, distinctly better than pyrazolotriazole couplers. Nonetheless, the image quality of the negative is still excessively dependent upon the composition of the developer; negatives are produced which give rise to images having a colour cast, or, more seriously, to images suffering from colour failure. Images suffering from colour failure cannot be corrected by filtering during the printing process, i.e. the photograph is irreparably damaged. Anilinopyrazolone magenta couplers are good colour couplers with regard to colour reproduction and colour saturation.

The object of the invention was to provide a colour photographic silver halide material having improved processing stability using anilinopyrazolone magenta couplers.

This object is achieved by the combined use of anilinopyrazolone magenta couplers of the formula (I) and DIR couplers of the formula (II).

The present invention accordingly provides a colour photographic silver halide material having a support and at least one photosensitive silver halide emulsion layer which contains a magenta coupler of the formula (I)

(I)

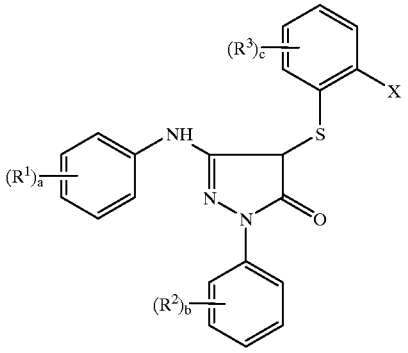

in which

X means —N($R^5$)S$R^4$, —N($R^5$)SO$R^4$, —N($R^5$)$SO_2R^4$ or —NHCO$R^4$ $R^1$means halogen, cyanogen, —$NO_2$, —$CF_3$, alkyl, aryl, acyl, alkylsulfonyl, arylsulfonyl, acylamino, sulfonamido or silyl;

$R^2$ means halogen, cyanogen, —$NO_2$, —$CF_3$, alkyl, aryl, alkoxy, alkylthio, acyl, alkylsulfonyl, arylsulfonyl, alkoxysulfonyl, aryloxysulfonyl, acylamino, sulfonamido or silyl;

$R^3$ means halogen, cyanogen, alkyl, aryl, acyl, alkylsulfonyl, arylsulfonyl or silyl;

$R^4$, $R^5$ mean alkyl, aryl, acyl, acylamino or silyl;

a, b (mutually independently) mean 0 or an integer from 1 to 5 and c means 0 or an integer from 1 to 4, wherein at least 16 C atoms are present in the thiophenol group, and which material contains a DIR coupler of the formula (II)

(II)

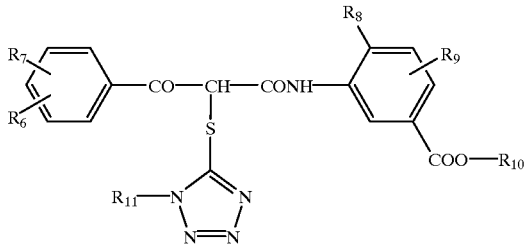

in which $R_6$ means alkyl or alkoxy, $R_7$ means hydrogen or a substituent;

$R_8$ means halogen, alkyl, aryl, alkoxy or aryloxy;

$R_9$ means hydrogen or a substituent;

$R_{10}$ means alkyl, alkylaryl or alkoxycarbonylalkyl and $R_{11}$ means aryl or alkyl.

$R_6$ is preferably alkoxy;

$R_7$ and $R_9$ are preferably hydrogen atoms;

$R_8$ is preferably halogen, in particular chlorine;

$R_{10}$ is preferably alkyl or alkoxycarbonylalkyl, $R_{11}$ is in particular phenyl.

In preferred embodiments of the invention, $R^3$ denotes H, $R^4$ denotes alkyl, aryl or acyl and $R^5$ denotes alkyl, aryl or acylamino.

The halogen represented by $R^1$, $R^2$ or $R^3$ is fluorine, chlorine or bromine. An alkyl group represented by $R^1$, $R^2$, $R^3$, $R^4$ or $R^5$ may contain, for example, 1–18 C atoms, be linear or branched and optionally be substituted; an alkyl group represented by $R^4$ contains, for example, 1–8 C atoms. An acyl group represented by one of the residues $R^1$, $R^2$, $R^3$ and $R^4$ or contained in an acylamino group represented by $R^5$ is derived, for example, from an aliphatic or aromatic carboxylic acid or from a carbonic acid semi-ester.

The residue of the formula

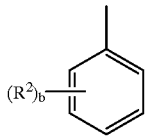

preferably has the meaning 2,4,6-trichlorophenyl.

The residue of the formula

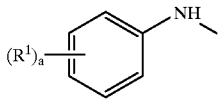

preferably has the meaning

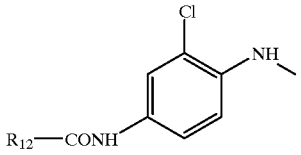

in which $R_{12}$ means unsubstituted or substituted alkyl.

X is in particular —N($R^5$)$So_2R^4$ or —NHCO$R^4$.

Examples of couplers of the formula (I) are:
M-1
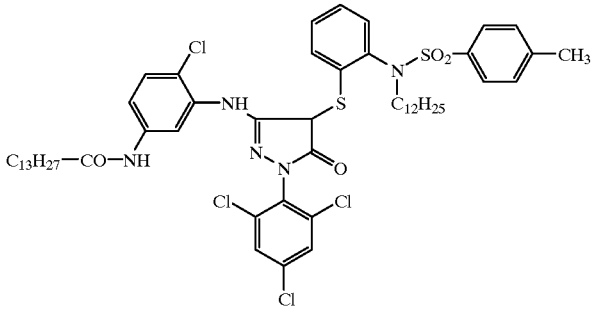
M-2
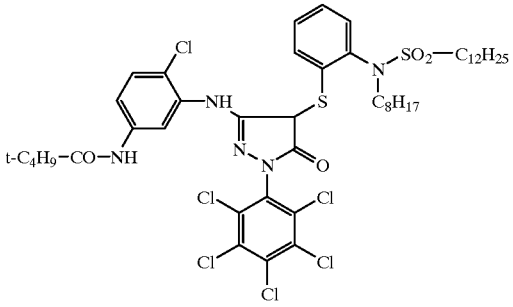
M-3
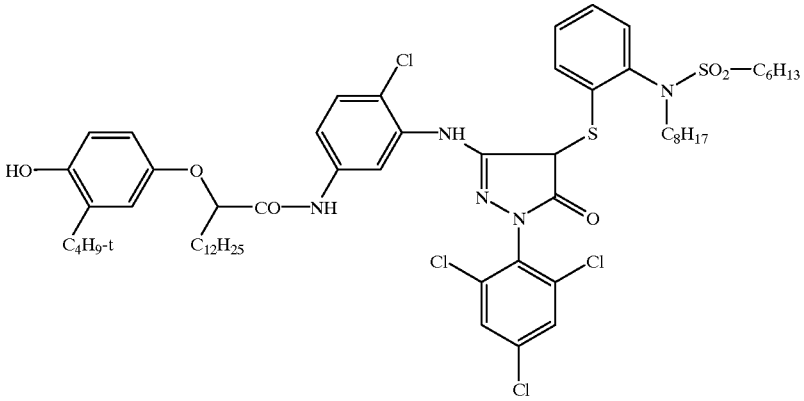
M-4
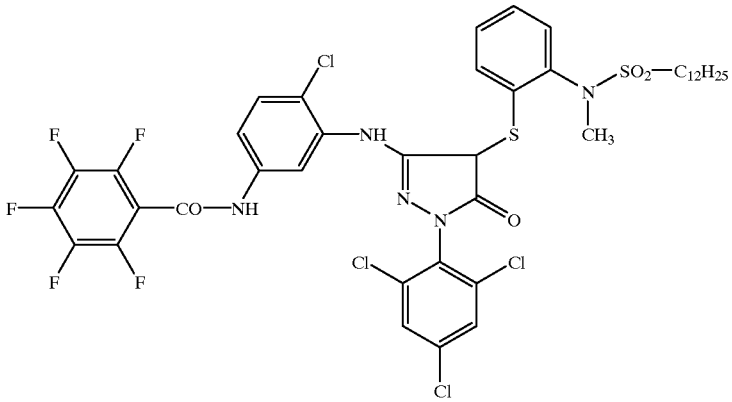
M-5
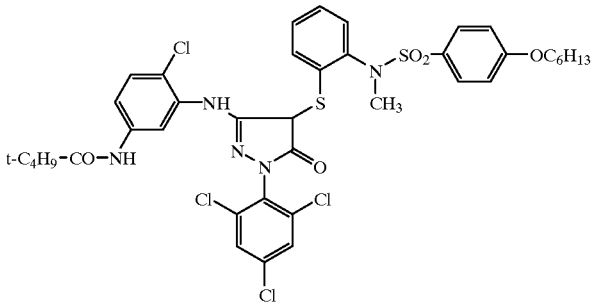
M-6
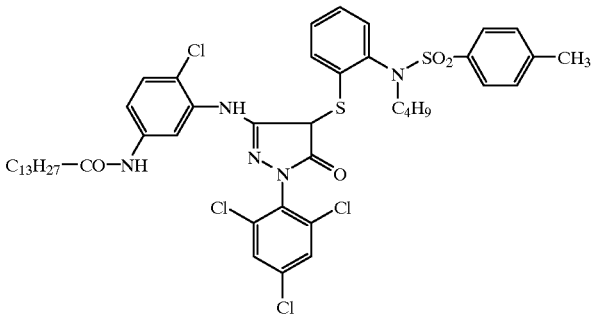

-continued
M-7
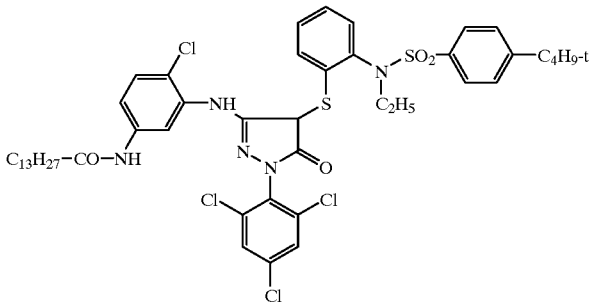
M-8
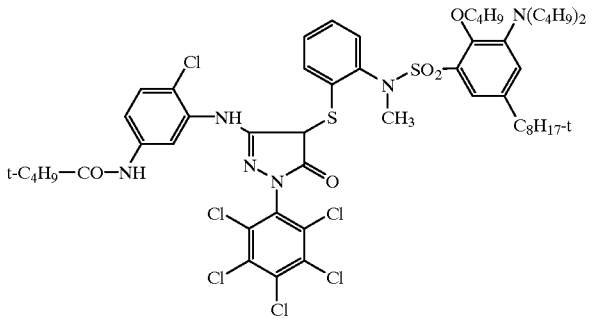
M-9
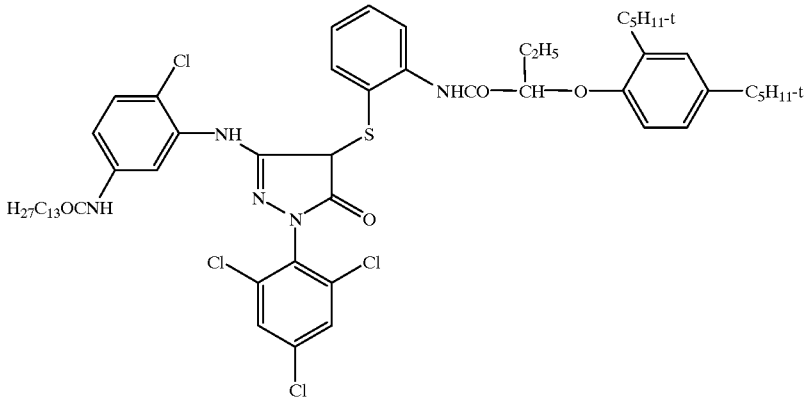
M-10
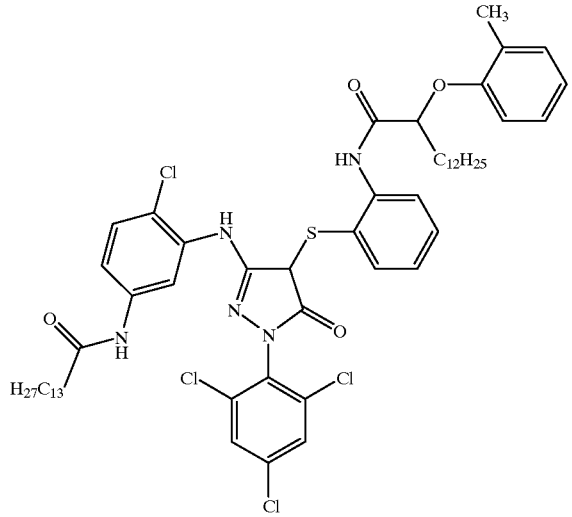
M-11
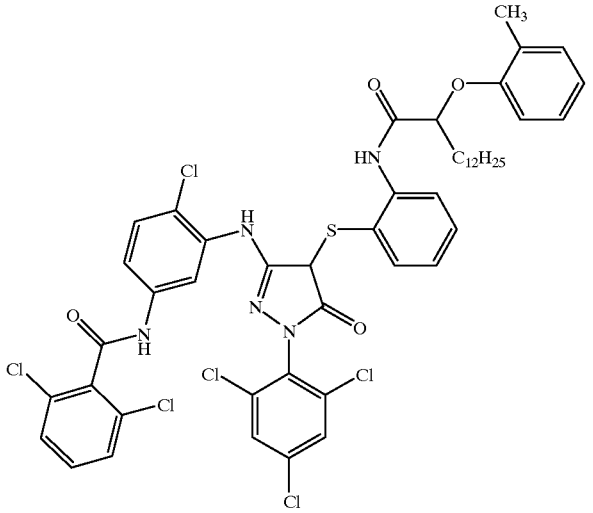

-continued

M-12

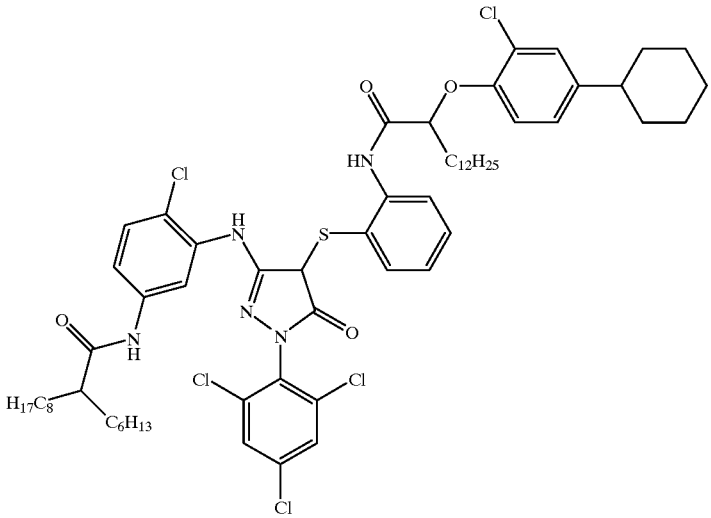

The couplers of the formula (I) and the production thereof are known from DE 195 25 666.

Suitable compounds of the formula (II) are of the formula

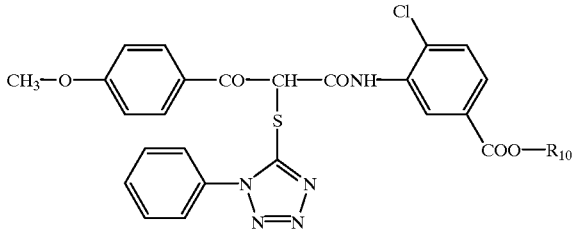

in which $R_{10}$ means an optionally substituted alkyl residue, for example

II-1: $R_{10}$=—$C_{12}H_{25}$

II-2: $R_{10}$=—$CH(CH_3)COOC_{12}H_{25}$

II-3: $R_{10}$=—$C_{14}H_{29}$

II-4: $R_{10}$=—$C_{16}H_{33}$.

The DIR coupler of the formula II is in particular used in a quantity of 5 to 50 $\mu$mol/m$^2$, the magenta coupler of the formula I in a quantity of 50 to 300 $\mu$mol/m$^2$.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285 and in *Research Disclosure* 38957, part XV (1996), page,627.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the sequence stated below, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sub-layers are generally arranged closer to the support than the more highly sensitive sub-layers.

A yellow filter layer is conventionally arranged between the green-sensitive and blue-sensitive layers which prevents blue light from reaching the underlying layers.

Possible options for different layer arrangements and the effects thereof on photographic properties are described in *J. Inf. Rec. Mats.,* 1994, volume 22, pages 183–193 and in *Research Disclosure* 38957, part XI (1996), page 624.

Colour photographic paper, which is usually substantially less photosensitive than a colour photographic film, conventionally has on the support, in the sequence stated below, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, in a photographic film, all high sensitivity layers may be grouped together in one package of layers and all low sensitivity layers may be grouped together in another package of layers in order to increase sensitivity (DE-25 30 645).

The substantial constituents of the photographic emulsion layers are binder, silver halide grains and colour couplers.

Details of suitable binders may be found in *Research Disclosure* 37254, part 2 (1995), page 286 and in *Research Disclosure* 38957, part IIA (1996), page 598.

Details of suitable silver halide emulsions, the production, ripening, stabilisation and spectral sensitisation thereof, including suitable spectral sensitisers, may be found in *Research Disclosure* 37254, part 3 (1995), page 286, in *Research Disclosure* 37038, part XV (1995), page 89 and in *Research Disclosure* 38957, part VA (1996), page 603.

Photographic materials with camera sensitivity conventionally contain silver bromide-iodide emulsions, which may optionally also contain small proportions of silver chloride. Photographic print materials contain either silver chloride-bromide emulsions with up to 80 mol % of AgBr or silver chloride-bromide emulsions with above 95 mol % of AgCl.

Details relating to colour couplers may be found in *Research Disclosure* 37254, part 4 (1995), page 288, in *Research Disclosure* 37038, part II (1995), page 80 and in *Research Disclosure* 38957, part XB (1996), page 616. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290, in *Research Disclosure* 37038, part XIV (1995), page 86 and in *Research Disclosure* 38957, part XC (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present in the layers as fine droplets (0.05 to 0.8 $\mu$m in diameter).

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292, in *Research Disclosure* 37038, part III (1995), page 84 and in *Research Disclosure* 38957, part XD (1996), page 621.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292, in *Research Disclosure* 37038, parts IV, V, VI, VII, X, XI and XIII (1995), pages 84 et seq. and in *Research Disclosure* 38957, parts VI, VIII, IX and X (1996), pages 607 and 610 et seq..

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294, in *Research Disclosure* 37038, part XII (1995), page 86 and in *Research Disclosure* 38957, part IIB (1996), page 599.

Once exposed with an image, colour photographic materials are processed using different processes depending upon their nature. Details relating to processing methods and the necessary chemicals are disclosed in *Research Disclosure* 37254, part 10 (1995), page 294, in *Research Disclosure* 37038, parts XVI to XXIII (1995), pages 95 et seq. and in *Research Disclosure* 38957, parts XVIII, XIX and XX (1996), pages 630 et seq. together with example materials.

EXAMPLE 1

A colour photographic recording material for colour negative development was produced (layer structure 1A) by applying the following layers in the stated sequence onto a transparent cellulose triacetate film base. Quantities are stated per 1 $m^2$. The silver halide application rate is stated as the corresponding quantities of $AgNO_3$; the silver halides are stabilised with 0.5 g of 4-hydroxy-6-methyl-1,3,3a,7-tetraazaindene per mol of $AgNO_3$.

| 1st layer | (Anti-halo layer) |
|---|---|
| 0.3 g | of black colloidal silver |
| 1.2 g | of gelatine |
| 0.3 g | of VU absorber UV-1 |
| 0.2 g | of DOP (developer oxidation product) scavenger SC-1 |
| 0.02 g | of tricresyl phosphate (TCP) |
| **2nd layer** | **(Low sensitivity red-sensitive layer)** |
| 0.7 g | of $AgNO_3$ of a spectrally red-sensitised AgBrI emusion, 4 mol % iodide, average grain diameter 0.42 $\mu$m |
| 1 g | of gelatine |
| 0.35 g | of colourless coupler C-1 |
| 0.05 g | of coloured coupler RC-1 |
| 0.03 g | of coloured coupler YC-1 |
| 0.36 g | of TCP |
| **3rd layer** | **(Medium sensitivity red-sensitive layer)** |
| 0.8 g | of $AgNO_3$ of a spectrally red-sensitised AgBrI emulsion, 5 mol % iodide, average grain diameter 0.52 $\mu$m |
| 0.6 g | of gelatine |
| 0.15 g | of colourless coupler C-2 |
| 0.03 g | of coloured coupler RC-1 |
| 0.02 g | of DIR coupler D-1 |
| 0.18 g | of TCP |
| **4th layer** | **(High sensitivity red-sensitive layer)** |
| 1 g | of $AgNO_3$ of a spectrally red-sensitised AgBrI emulsion, 6 mol % iodide, average grain diameter 0.85 $\mu$m |
| 1 g | of gelatine |
| 0.1 g | of colourless coupler C-2 |
| 0.005 g | of DIR coupler D-2 |
| 0.11 g | of TCP |
| **5th layer** | **(Interlayer)** |
| 0.8 g | of gelatine |
| 0.07 g | of DOP scavenger SC-2 |
| 0.06 g | of aurintricarboxylic acid, aluminium salt |
| **6th layer** | **(Low sensitivity green-sensitive layer)** |
| 0.7 g | of $AgNO_3$ of a spectrally green-sensitised AgBrI emulsion, 4 mol % iodide, average grain diameter 0.35 $\mu$m |
| 0.8 g | of gelatine |
| 0.23 g | of colourless coupler M-6 |
| 0.065 g | of coloured coupler YM-1 |
| 0.0015 g | of DIR coupler D-3 |
| 0.18 g | of TCP |

-continued

| 7th layer | (Medium sensitivity green-sensitive layer) |
|---|---|
| 0.9 g | of $AgNO_3$ of a spectrally green-sensitised AgBrI emulsion, 4 mol % iodide, average grain diameter 0.50 μm |
| 1 g | of gelatine |
| 0.14 g | of colourless coupler M-6 |
| 0.04 g | of coloured coupler YM-1 |
| 0.01 g | of DIR coupler D-3 |
| 0.11 g | of TCP |
| **8th layer** | **(High sensitivity green-sensitive layer)** |
| 0.6 g | of $AgNO_3$ of a spectrally green-sensitised AgBrI emulsion, 6 mol % iodide, average grain diameter 0.70 μm |
| 1.1 g | of gelatine |
| 0.08 g | of colourless coupler M-6 |
| 0.01 g | of coloured coupler YM-2 |
| 0.02 g | of DIR coupler D-4 |
| 0.04 g | of TCP |
| **9th layer** | **(Yellow filter layer)** |
| 0.09 g | of yellow dye GF-1 |
| 1 g | of gelatine |
| 0.08 g | of DOP scavenger SC-2 |
| 0.26 g | of TCP |
| **10th layer** | **(Low sensitivity blue-sensitive layer)** |
| 0.3 g | of $AgNO_3$ of a spectrally blue-sensitised AgBrI emulsion, 6 mol % iodide, average grain diameter 0.44 μm |

-continued

| | |
|---|---|
| 0.5 g | of $AgNO_3$ of a spectrally blue-sensitised AgBrI emulsion, 6 mol % iodide, average grain diameter 0.50 μm |
| 1.9 g | of gelatine |
| 1.1 g | of colourless coupler Y-1 |
| 0.03 g | of DIR coupler D-5 |
| 0.6 g | of TCP |
| **11th layer** | **(High sensitivity blue-sensitive layer)** |
| 0.6 g | of $AgNO_3$ of a spectrally blue-sensitised AgBrI emulsion, 7 mol % iodide, average grain diameter 0.95 μm |
| 1.2 g | of gelatine |
| 0.1 g | of colourless coupler Y-1 |
| 0.006 g | of DIR coupler D-5 |
| 0.11 g | of TCP |
| **12th layer** | **(Micrate layer)** |
| 0.1 g | of $AgNO_3$ of a micrate AgBrI emulsion, 0.5 mol % iodide, average grain diameter 0.06 μm |
| 1.2 g | of gelatine |
| 0.1 g | $K_2[PdCl_4]$ |
| 0.006 g | of UV absorber UV-2 |
| 0.11 g | of TCP |
| **13th layer** | **(Protective & hardening layer)** |
| 0.25 g | of gelatine |
| 0.75 g | of hardener H-1 |

Once hardened, the overall layer structure had a swelling factor of ≦3.5.

Compounds used in Example 1:

UV-1

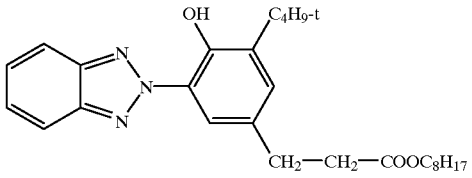

UV-2

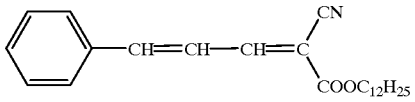

C-1

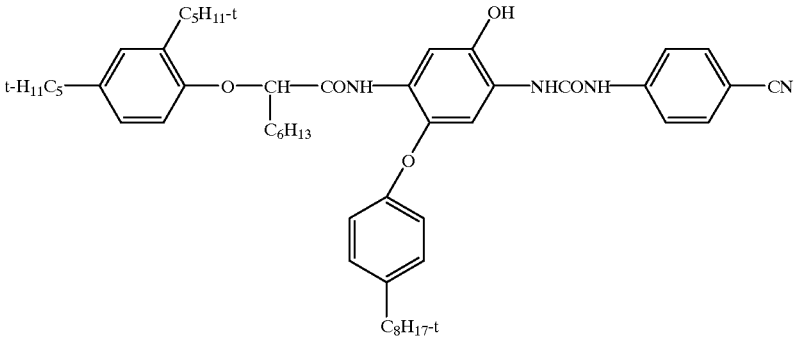

-continued
C-2
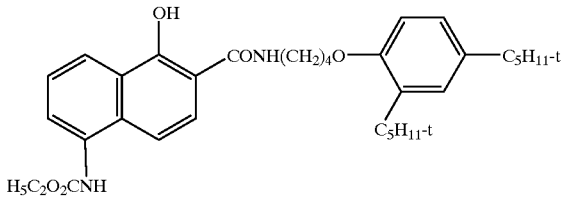
RC-1
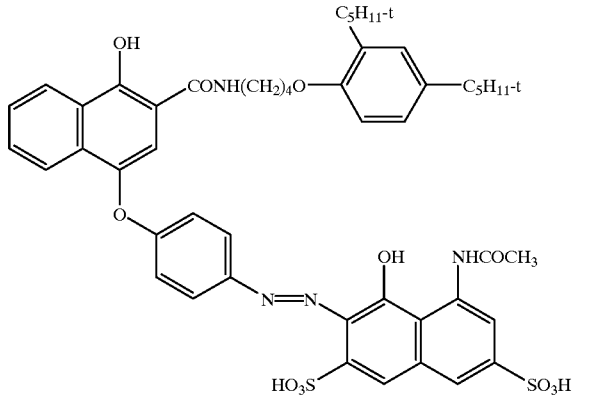
YC-1
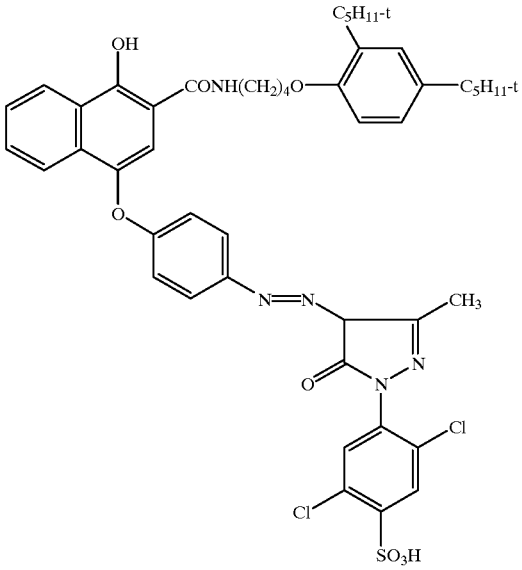
YM-1
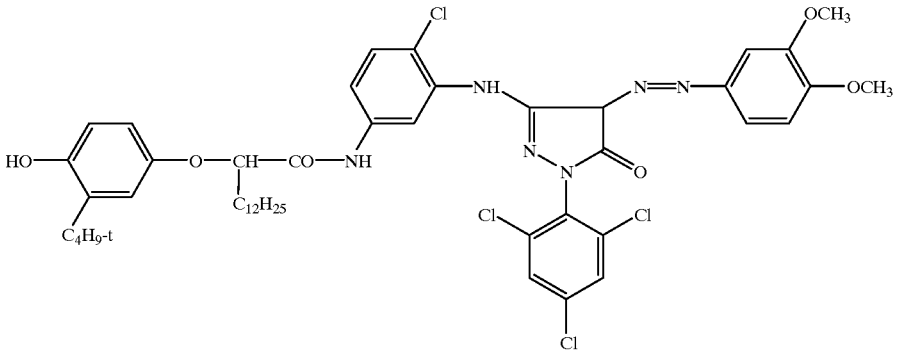
YM-2
Y-1
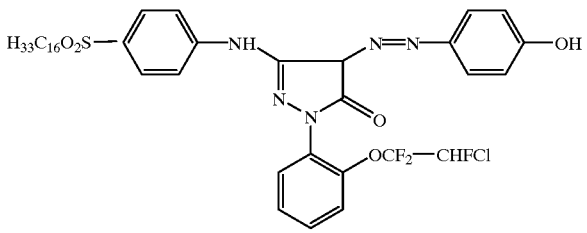
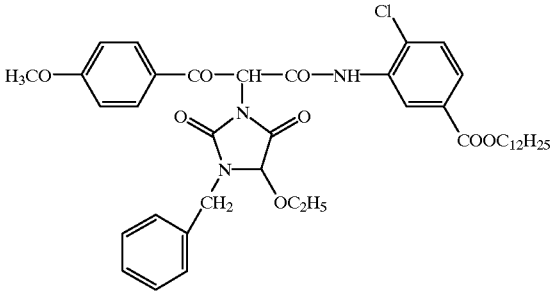

-continued
D-1
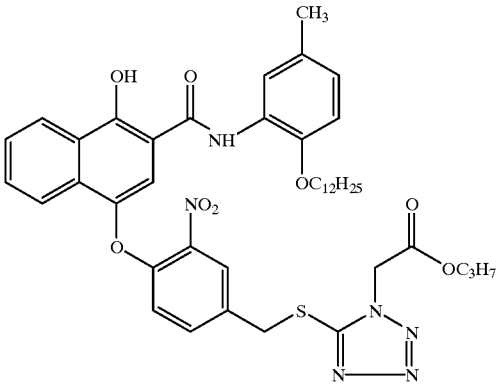
D-2
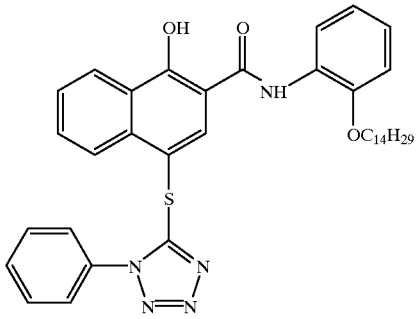
D-3
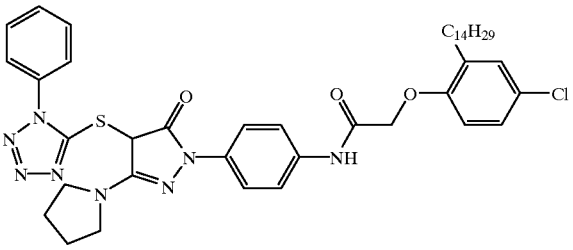
D-4
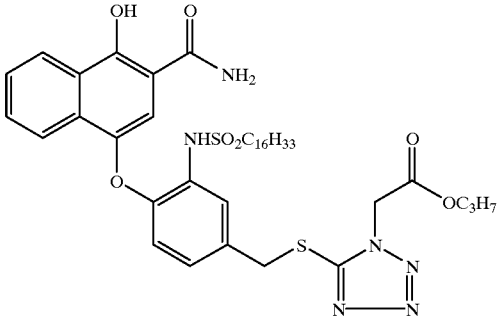
D-5
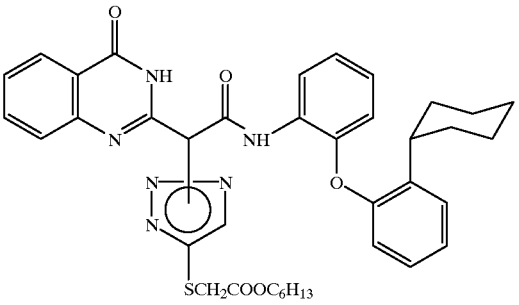
SC-1
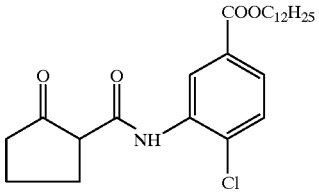
SC-2
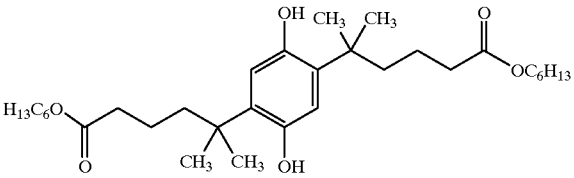
GF-1
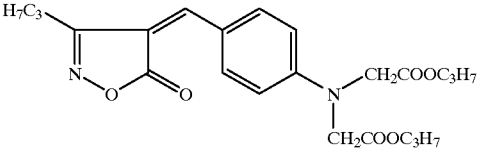
H-1
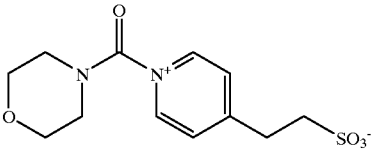

After exposure with a grey wedge, development is performed in accordance with *The British Journal of Photography,* 1974, pages 597 and 598. In so doing, the developer solution is varied in accordance with Table 1.

TABLE 1

| Composition of the developer solutions | | | | |
|---|---|---|---|---|
| Developer solution | EL-1 | EL-2 | EL-3 | EL-4 |
| DTPA-$Na_5$ soln. | 6.5 ml | 5.5 ml | 4.9 ml | 7.4 ml |
| $K_2CO_3$ | 31.55 g | 29.1 g | 23.7 g | 34.0 g |
| $KHCO_3$ | 4.75 g | 2.9 g | 3.6 g | 6.6 g |
| KBr | 1.47 g | 1.1 g | 1.1 g | 2.0 g |
| KI | 1.2 mg | 0 mg | 0.9 mg | 2.4 mg |
| $NH_2OH$ | 2.4 g | 2.4 g | 1.8 g | 2.4 g |
| $Na_2SO_3$ | 4.33 g | 4.0 g | 3.3 g | 4.7 g |
| $CD_4$ | 4.5 g | 4.5 g | 3.4 g | 4.5 g |

DTPA $N_5$ solution is a 40 wt. % aqueous solution of the pentasodium salt of diethylenetriaminepentaacetic acid. CD4 is the colour developer of the formula

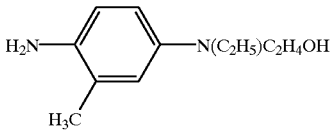

In layer structures 1B to 1F, different DIR couplers and colour couplers are used in the $6^{th}$ and $7^{th}$ layers to those used in layer structure 1A. The compounds used are shown in Table 2.

TABLE 2

| Layer structure | Layer | Colour coupler [$\mu$mol/m$^2$] | DIR coupler [$\mu$mol/m$^2$] | |
|---|---|---|---|---|
| 1A | $6^{th}$ | M-6 [243] | D-3 [19] | Comparison |
| | $7^{th}$ | M-6 [148] | D-3 [13] | |
| 1B | $6^{th}$ | M-6 [243] | D-2 [18] | Comparison |
| | $7^{th}$ | M-6 [148] | D-2 [12] | |
| 1C | $6^{th}$ | M-6 [243] | II-1 [19] | Invention |
| | $7^{th}$ | M-6 [148] | II-1 [13] | |
| 1D | $6^{th}$ | M-6 [243] | II-2 [20] | Invention |
| | $7^{th}$ | M-6 [148] | II-2 [13] | |
| 1E | $6^{th}$ | M-9 [241] | II-1 [22] | Invention |
| | $7^{th}$ | M-9 [150] | II-2 [14] | |
| 1F | $6^{th}$ | M-9 [241] | II-2 [22] | Invention |
| | $7^{th}$ | M-9 [150] | II-2 [16] | |

Table 3 states the changes in the filter differences as a function of the developer solution used. The filter differences are the differences in density between the density measured behind a blue filter and behind a green filter ($\Delta D_{BG}$) and between the density measured behind a red filter and behind a green filter ($\Delta D_{RG}$) at an exposure of 0.8 log E above the green sensitivity point, which is defined by a magenta density of 0.15 above fog. Since processing should have the least possible influence upon the filter differences, small changes in the filter differences are advantageous. This is most effectively achieved in the materials according to the invention.

TABLE 3

| Layer structure | Gradation, green*) | Change in filter differences**) ($\Delta D_{BG}$) | ($\Delta D_{RG}$) | |
|---|---|---|---|---|
| 1A | 100 | 10/−5/−9 | 8/3/−5 | Comparison |
| 1B | 97 | 12/−7/−9 | 10/2/−9 | Comparison |
| 1C | 109 | 5/−3/−4 | 8/2/"4 | Invention |
| 1D | 106 | 4/−4/−5 | 7/1/−3 | Invention |
| 1E | 98 | 6/−4/−3 | 6/2/−4 | Invention |
| 1F | 108 | 4/−4/−5 | 8/1/−5 | Invention |

*)at density 0.2 to 0.8 above fog
**)between the developer variants EL-2, EL-3 and EL-4, in each case relative to EL-1 (EL-2 − EL-1)/(EL-3 − EL-1)/(EL-4 − EL-1)

As may be seen, the materials according to the invention exhibit improved processing stability.

What is claimed is:

1. A color photographic silver halide material which comprises a support and at least one photosensitive silver halide emulsion layer which contains a magenta coupler of the formula (I)

(I)

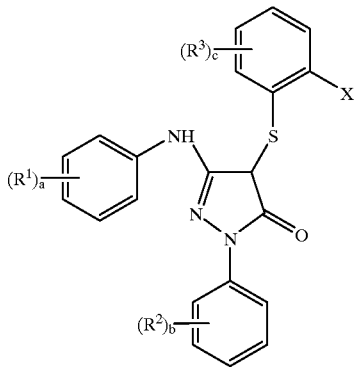

in which

X means —N($R^5$)S$R^4$, —N($R^5$)SO$R^4$ or —N($R^5$)$SO_2R^4$ $R^1$ means halogen, cyanogen, —$NO_2$, —$CF_3$, alkyl, aryl, acyl, alkylsulfonyl, arylsulfonyl, acylamino, sulfonamido or silyl;

$R^2$ means halogen, cyanogen, —$NO_2$, —$CF_3$, alkyl, aryl, alkoxy, alkylthio, acyl, alkylsulfonyl, arylsulfonyl, alkoxysulfonyl, aryloxysulfonyl, acylamino, sulfonamido or silyl;

$R^3$ means halogen, cyanogen, alkyl, aryl, acyl, alkylsulfonyl, arylsulfonyl or silyl;

$R^4$ and $R^5$ (mutually independently) mean alkyl, aryl, acyl, acylamino or silyl;

a and b (mutually independently) mean 0 or an integer from 1 to 5 and c means 0 or an integer from 1 to 4, wherein at least 16 C atoms are present in the thiophenyl group, and which material contains a DIR coupler of the formula (II)

(II)

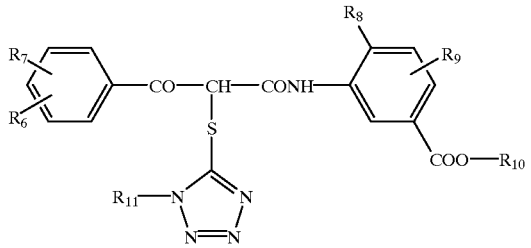

in which $R_6$ means alkyl or alkoxy, $R_7$ means hydrogen or a substituent;

$R_8$ means halogen, alkyl, aryl, alkoxy or aryloxy;

$R_9$ means hydrogen or a substituent;

$R_{10}$ means alkyl, alkylaryl or alkoxycarbonylalkyl and $R_{11}$ means aryl or alkyl.

2. The color photographic silver halide material according to claim 1, in which $R_6$ means alkoxy, $R_7$ and $R_9$ each mean H, $R_8$ means halogen, $R_{10}$ means alkyl or alkoxycarbonylalkyl and $R_{11}$ means phenyl.

3. The color photographic silver halide material according to claim 1, in which $R^3$ means hydrogen, $R^4$ means alkyl, aryl or acyl, $R^5$ means alkyl, aryl or acylamino, X means $—N(R^5)SO_2R^4$ the residue

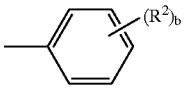

means 2,4,6-trichlorophenyl and the residue

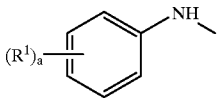

has the meaning

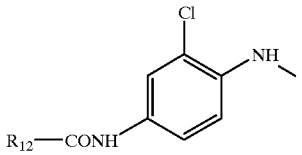

in which $R_{12}$ means unsubstituted or substituted alkyl.

4. The color photographic silver halide material according to claim 1, wherein, both a magenta coupler of the formula (I) and a DIR coupler of the formula (II) are present in at least one green-sensitive silver halide emulsion layer.

5. The color photographic silver halide material according to claim 1, wherein the DIR coupler of the formula (II) is present in a layer in a quantity of 5 to 50 $\mu mol/m^2$.

6. The color photographic silver halide material according to claim 1, wherein the magenta coupler of the formula (I) is present in the silver halide emulsion layer, of which there is at least one, in a quantity of 50 to 300 $\mu mol/m^2$.

7. The color photographic silver halide material according to claim 1, wherein the material contains on a transparent support, in the sequence stated below, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers and optionally interlayers and protective layers, at least one of the green-sensitive layers contains a magenta coupler of the formula (I) and at least one of the layers contains a DIR coupler of the formula (II).

8. The color photographic silver halide material according to claim 2, wherein $R_8$ is chlorine.

9. The color photographic silver halide material according to claim 1, wherein DIR coupler of formula (II) is of the formula

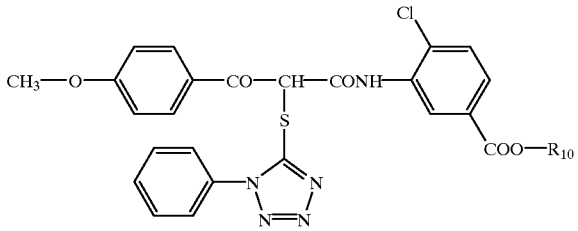

wherein $R_{10}$ is alkyl or alkoxycarbonylalkyl.

10. The color photographic silver halide material according to claim 9, wherein $R_{10}$ is alkyl.

* * * * *

UNITED STATES PATENT AND TRADEMARK OFFICE

CERTIFICATE OF CORRECTION

PATENT NO. : 6,218,097 B1
DATED : April 17, 2001
INVENTOR(S) : Peter Bell et al.

It is certified that error appears in the above-identified patent and that said Letters Patent is hereby corrected as shown below:

Title page,
Item [73] Assignee, "Agfa-Gevaert (DE)" should read -- AGFA-GEVAERT (BE) --.

Signed and Sealed this

Fifth Day of February, 2002

*Attest:*

*Attesting Officer*

JAMES E. ROGAN
*Director of the United States Patent and Trademark Office*